US011066809B2

(12) United States Patent
Zell et al.

(10) Patent No.: US 11,066,809 B2
(45) Date of Patent: Jul. 20, 2021

(54) MOTOR GRADER SADDLE POSITIONING SYSTEM AND METHOD THEREOF

(71) Applicant: DEERE & COMPANY, Moline, IL (US)

(72) Inventors: Adam Zell, Dubuque, IA (US); Joseph B. Fochs, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 179 days.

(21) Appl. No.: 16/171,423

(22) Filed: Oct. 26, 2018

(65) Prior Publication Data

US 2020/0131732 A1 Apr. 30, 2020

(51) Int. Cl.

| | |
|---|---|
| ***E02F 3/76*** | (2006.01) |
| ***E02F 9/22*** | (2006.01) |
| ***E02F 9/20*** | (2006.01) |

(52) U.S. Cl.

CPC ..... *E02F 3/765* (2013.01); *E02F 3/7645* (2013.01); *E02F 9/2041* (2013.01); *E02F 9/2271* (2013.01); *E02F 3/764* (2013.01)

(58) Field of Classification Search

CPC ..... E02F 3/765; E02F 3/7654; E02F 3/7645; E02F 9/2041; E02F 3/764; E02F 9/2271

USPC ..... 172/793

See application file for complete search history.

(56) References Cited

U.S. PATENT DOCUMENTS 2,247,007 A * 6/1941 Arndt ..... E02F 3/765 172/793
2,655,743 A * 10/1953 Ross ..... E02F 3/765 172/793
3,421,589 A * 1/1969 Rivinius ..... E02F 3/844 172/4.5
3,455,400 A 7/1969 Hanser et al.
3,677,350 A * 7/1972 Johnson et al. ..... E02F 3/765 172/789

(Continued)

FOREIGN PATENT DOCUMENTS

| | | | |
|---|---|---|---|
| DE | 1484654 | B1 | 11/1970 |
| DE | 102008037933 | A1 | 4/2009 |
| WO | 8805482 | A1 | 7/1988 |

OTHER PUBLICATIONS

German Search Report issued in counterpart application No. 102019216397.1 dated Jul. 23, 2020 (10 pages).

*Primary Examiner* — Thomas B Will
*Assistant Examiner* — Joel F. Mitchell
(74) *Attorney, Agent, or Firm* — Taft Stettinius & Hollister LLP; Stephen F. Rost

(57) ABSTRACT

A draft frame positioning system of a motor grader having a main frame includes an adjustable draft frame configured to be moved to one of a plurality of positions and a moldboard coupled to the draft frame. The moldboard is movable based on the position of the draft frame. A saddle assembly is coupled between the draft frame and the main frame, and the saddle assembly includes a first saddle arm, a second saddle arm, and a saddle top member coupled between the first and second saddle arms. A saddle positioning cylinder moves between an extended position and a retracted position, and the cylinder is coupled at one end to the main frame or the saddle top member and at an opposite end to the saddle assembly. A movement of the saddle positioning cylinder induces movement of the draft frame to any of its plurality of positions.

18 Claims, 6 Drawing Sheets

(56) References Cited

U.S. PATENT DOCUMENTS

| | | | | | |
|---|---|---|---|---|---|
| 3,739,861 | A * | 6/1973 | Johnson et al. | E02F 3/765 | 172/793 |
| 3,986,563 | A * | 10/1976 | Stubben | E02F 3/765 | 172/793 |
| 4,175,625 | A * | 11/1979 | Puckett | E02F 3/765 | 172/791 |
| 4,340,119 | A * | 7/1982 | MacDonald | E02F 9/121 | 172/743 |
| 4,696,350 | A * | 9/1987 | Ruhter et al. | E02F 3/764 | 172/753 |
| 4,852,659 | A * | 8/1989 | Ross et al. | E02F 3/76 | 172/789 |
| 8,360,165 | B2 * | 1/2013 | Leith | A01B 59/06 | 172/821 |
| 2016/0153166 | A1 | 6/2016 | Gentle et al. | | |
| 2017/0284067 | A1 | 10/2017 | Tevis et al. | | |

* cited by examiner

MOTOR GRADER SADDLE POSITIONING SYSTEM AND METHOD THEREOF

FIELD OF THE DISCLOSURE

The present disclosure relates to controlling a saddle position of a motor grader, and in particular to position sensing system for controlling the saddle position.

BACKGROUND OF THE DISCLOSURE

In a conventional motor grader, a draft frame of the grader, and therefore a moldboard, is positioned by three different cylinders attached via a four-bar linkage known as a saddle. In this conventional arrangement, the saddle position is limited to a number of discrete positions, which limits the use of the moldboard. Moreover, the saddle position is adjustable only with the moldboard on the ground, and requires manual adjustment.

It is desirable, however, to be able to adjust the saddle position and thus the moldboard to an infinite number of positions. Further, there is a desire to be able to adjust the saddle when the moldboard is disposed above the ground and without requiring manual intervention.

SUMMARY

In one embodiment of the present disclosure, a draft frame positioning system of a motor grader having a main frame includes an adjustable draft frame configured to be moved to one of a plurality of positions; a moldboard coupled to the draft frame, the moldboard being movable based on the position of the draft frame; a saddle assembly coupled between the draft frame and the main frame, the saddle assembly comprising a first saddle arm, a second saddle arm, and a saddle top member coupled between the first and second saddle arms; and a saddle positioning cylinder configured to move between an extended position and a retracted position, the saddle positioning cylinder being coupled at one end to the main frame or saddle top member and at an opposite end to the saddle assembly; wherein, a movement of the saddle positioning cylinder induces movement of the draft frame to any of its plurality of positions.

In one example of this embodiment, the saddle positioning cylinder is coupled to the first or second saddle arm of the saddle assembly. In a second example, the saddle assembly comprises a saddle lock bar pivotally coupled between the first saddle arm and the second saddle arm; the saddle positioning cylinder coupled to the saddle lock bar. In a third example, the system may include a first lift cylinder coupled between the first saddle arm and the draft frame; a second lift cylinder coupled between the second saddle arm and the draft frame; and a side shift cylinder coupled between the draft frame and the saddle assembly.

In a fourth example, movement of the saddle positioning cylinder induces movement of the draft frame a first non-discrete position to a second non-discrete position. In a fifth example, the saddle assembly does not include a lock bar or locking pin such that the position of the draft frame is not defined by engaging the locking pin with the lock bar.

In a sixth example, a second saddle positioning cylinder is configured to move between an extended position and a retracted position, the second saddle positioning cylinder being coupled at one end to the main frame or the saddle top member and at an opposite end to the saddle assembly. In a related example, the saddle positioning cylinder may be coupled to the first saddle arm and the second saddle positioning cylinder is coupled to the second saddle arm. Further, the saddle positioning cylinder and the second saddle positioning cylinder may both be coupled to the saddle top member. In a further example of this embodiment, the movement of the saddle positioning cylinder is independent of the movement of the second saddle positioning cylinder.

In another embodiment of the present disclosure, a draft frame positioning system of a motor grader having a main frame includes an adjustable draft frame configured to be moved to one of a plurality of positions; a moldboard coupled to the draft frame, the moldboard being movable based on the position of the draft frame; a saddle assembly coupled between the draft frame and the main frame, the saddle assembly comprising a first saddle arm, a second saddle arm, and a saddle top member coupled between the first and second saddle arms; and a first saddle positioning cylinder configured to move between an extended position and a retracted position, the first saddle positioning cylinder being coupled at one end to the main frame or saddle top member and at an opposite end to the saddle assembly; a second saddle positioning cylinder configured to move between an extended position and a retracted position, the second saddle positioning cylinder being coupled at one end to the main frame or saddle top member and at an opposite end to the saddle assembly; wherein, a movement of the first saddle positioning cylinder is independent of a movement of the second saddle positioning cylinder; wherein, the movement of either the first or the second saddle positioning cylinder induces movement of the draft frame to one of any of its plurality of positions.

In one example of this embodiment, the first saddle positioning cylinder is coupled to the first saddle arm and the second saddle positioning cylinder is coupled to the second saddle arm. In another example, the first saddle arm and the second saddle arm are movable independently of one another. In yet another example, a first lift cylinder is coupled between the first saddle arm and the draft frame; a second lift cylinder is coupled between the second saddle arm and the draft frame; and a side shift cylinder is coupled between the draft frame and the saddle assembly. In a further example, movement of either the first or second saddle positioning cylinder induces movement of the draft frame from a first non-discrete position to a second non-discrete position. In yet a further example, the first saddle positioning cylinder and the second saddle positioning cylinder are coupled to the saddle top member.

In a further embodiment of the present disclosure, a motor grader includes a main frame; a draft frame adjustably coupled to the main frame, the draft frame configured to be adjusted to any of a plurality of positions; a moldboard configured to perform a grading operation, the moldboard coupled to the draft frame; a saddle assembly coupled between the draft frame and the main frame, the saddle assembly comprising a first saddle arm, a second saddle arm, and a saddle top member coupled between the first and second saddle arms; a saddle positioning cylinder configured to move between an extended position and a retracted position, the saddle positioning cylinder being coupled at one end to the main frame or saddle top member and at an opposite end to the saddle assembly; and a control system comprising a controller, a saddle positioning sensor, a first saddle arm sensor, and a second saddle arm sensor; wherein, a movement of the saddle positioning cylinder induces movement of the draft frame to any of its plurality of positions; wherein, the saddle positioning sensor is electrically coupled to the controller and is configured to detect a position of the saddle positioning cylinder and communicate the position to the controller.

In one example of this embodiment, the position of the draft frame is adjustably controlled automatically via the controller, the controller configured to automatically control movement of the saddle positioning cylinder. In another example, the motor grader may include a second saddle positioning cylinder configured to move between an extended position and a retracted position, the second saddle positioning cylinder being coupled at one end to the main frame or saddle top member and at an opposite end to the saddle assembly; and a second saddle positioning sensor electrically coupled to the controller and configured to detect a position of the second saddle positioning cylinder; wherein, a movement of the second saddle positioning cylinder is controlled independently of the saddle positioning cylinder; wherein, a movement of the second saddle positioning cylinder induces movement of the draft frame.

In a further example, the saddle positioning cylinder is coupled to the first saddle arm; and the second saddle positioning cylinder is coupled to the second saddle arm; wherein, movement of either the first saddle arm or the second saddle arm is independently controlled relative to the other.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
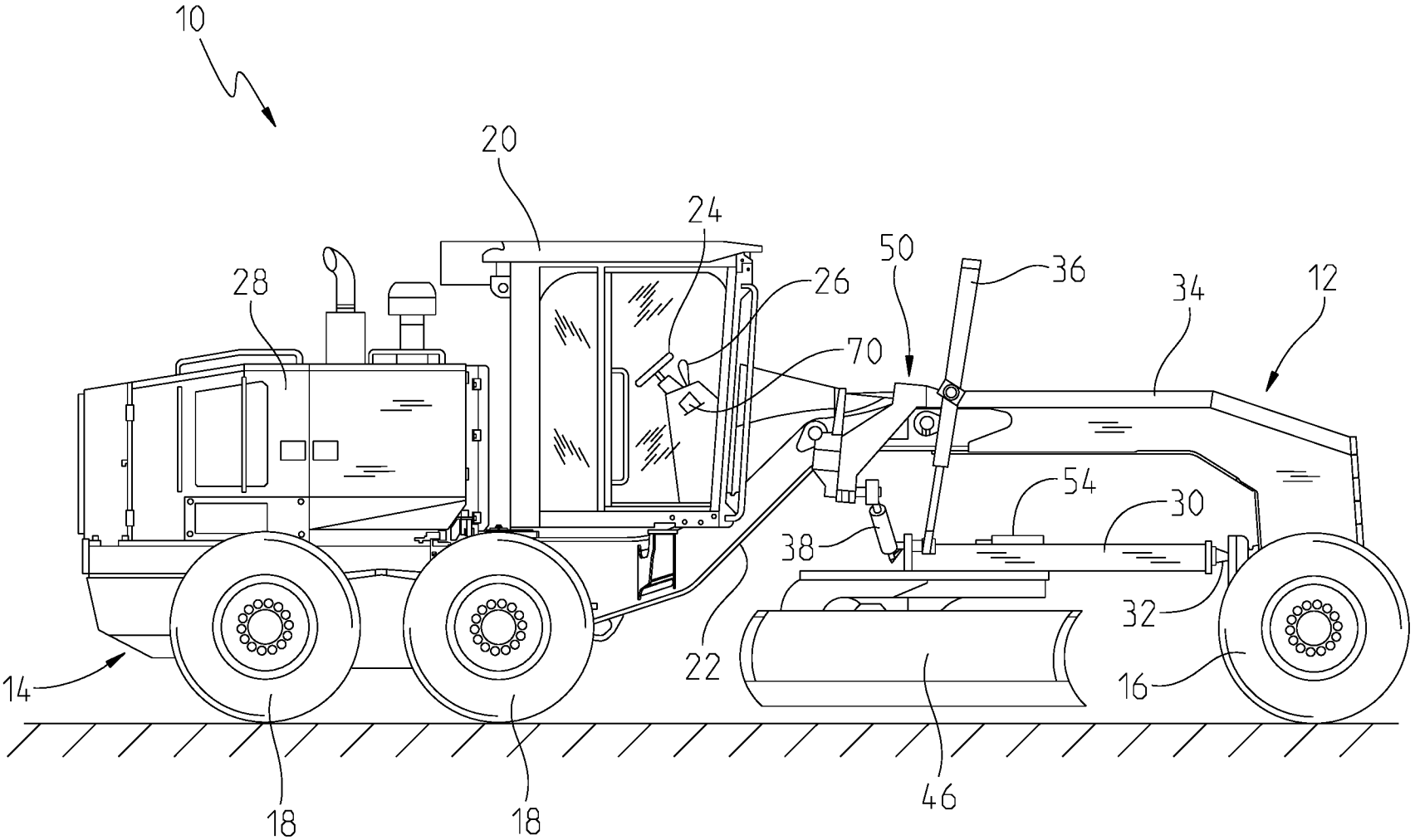
FIG. 1 is a side view of a motor grader.

Referring to FIG. 1, a motor grader 10 is shown including front and rear frames 12 and 14, respectively, with the front frame being supported on a pair of front wheels 16, and with the rear frame being supported on right and left tandem sets of rear wheels 18. An operator cab 20 is mounted on an upwardly and forwardly inclined rear region 22 of the front frame 12 and contains various controls for the motor grader disposed so as to be within the reach of a seated or standing operator. These controls including a steering wheel 24, a lever assembly 26, and a user interface 70 to name a few.

An engine 28 is mounted on the rear frame 14 and supplies the driving power for all driven components of the motor grader. For example, the engine 28 is coupled for driving a transmission coupled to the rear wheels 18 at various selected speeds and either in forward or reverse modes. A hydrostatic front wheel assist transmission may be selectively engaged to power the front wheels 16, in a manner well known in the art. Further, the engine 28 may be coupled to a pump or a generator to provide hydraulic, pneumatic, or electrical power to the motor grader 10 as is known in the art.

Mounted to a front location of the front frame 12 is a drawbar 30, having a forward end universally connected to the front frame by a ball and socket arrangement 32 and having opposite right and left rear regions suspended from an elevated central section 34 of the main frame 12 by right and left lift linkage arrangements including right and left extensible and retractable hydraulic actuators (only right actuator 36 is shown). A side shift linkage arrangement is coupled between the elevated frame section 34 and a rear location of the drawbar 30 and includes an extensible and retractable side swing hydraulic actuator 38.

Figure 2:
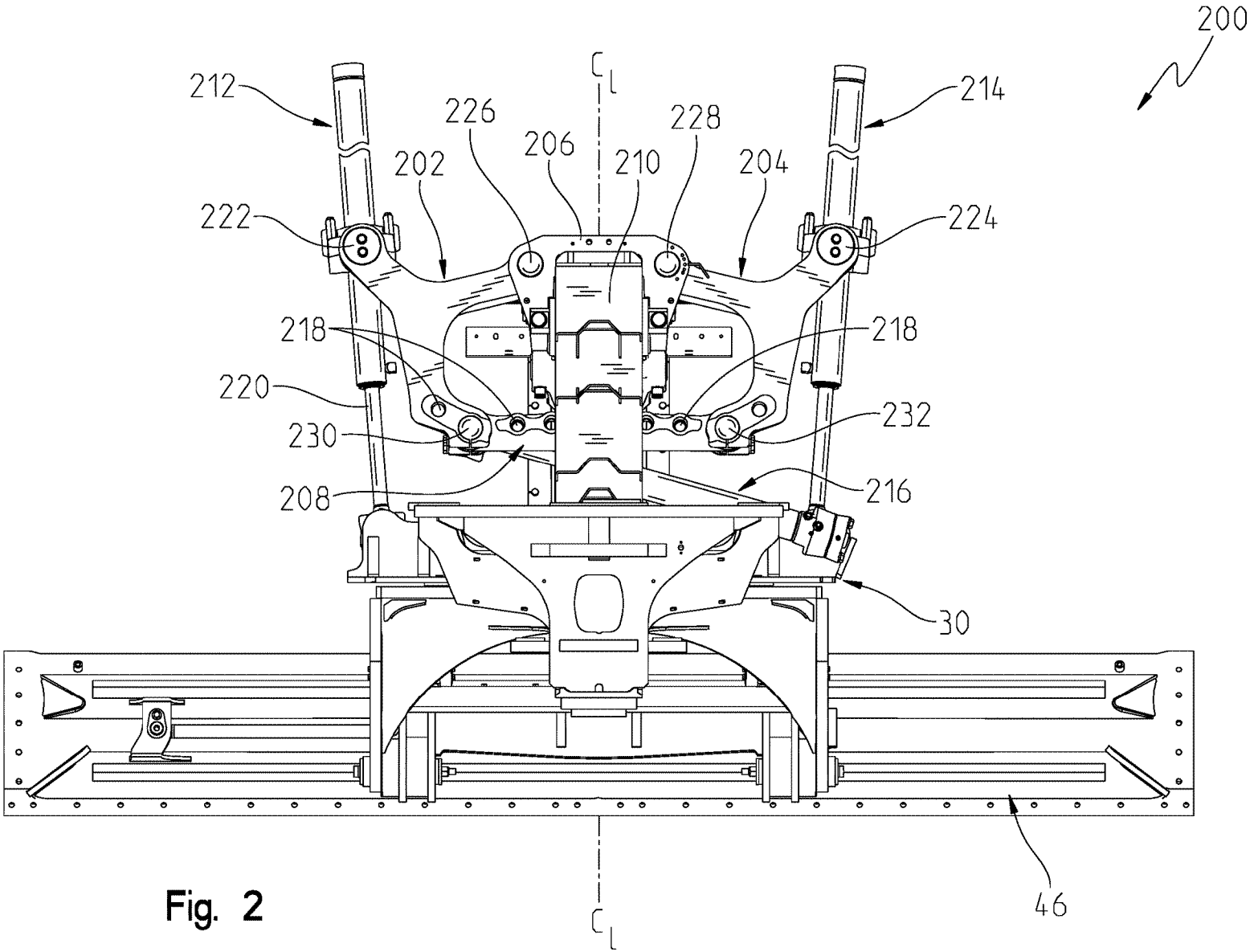
FIG. 2 is a rear view of a portion of a conventional saddle of a motor grader.

The right, left, and side swing hydraulic actuators 36, 38 may be repositionable to alter a cross slope of a moldboard or blade 46 via a four-bar linkage referred to as a saddle assembly 50 (see FIG. 2). The saddle assembly 50 will be described in more detail below. The cross slope may be the angle of the blade 46 relative to the underlying surface. More specifically, the wheels 16, 18 of the motor grader 10 may rest on the underlying surface to establish a surface plane. The actuators 36, 38 may be selectively resized to pivot the blade 46 about the ball and socket arrangement 32 to thereby change the angular orientation of the blade 46 relative to the underlying surface or surface plane. For example, the actuators 36, 38 may have a neutral position wherein the left and right actuators 36 are sized to ensure the blade 46 is substantially parallel with the underlying surface. Alternatively, the actuators 36, 38 may have a cross slope orientation where the actuators 36, 38 are sized to angularly offset the blade 46 relative to the underlying surface. The cross slope of the blade 46 may be biased towards either side of the motor grader as is known in the art.

The blade 46 may also be mounted on a side shift assembly (not shown) to slidably move between a first side and a second side. More specifically, a hydraulic side shift actuator (see FIG. 2) interconnects a tilt frame and the side shift assembly and is operable to side shift the blade 46 relative to a longitudinal axis (or centerline) of the work machine 10. Further, the side shift actuator may selectively slide the blade 46 along the side shift assembly to be biased towards different sides of the longitudinal axis as desired by the user.

Also in FIG. 1 is a circle drive motor 54 that may include an outer shaft for operably driving a circle drive (not shown). A circle (not shown in FIG. 1) is mounted to a rear region of the drawbar 30 for rotation about an upright axis as known in the art. The blade 46, or moldboard, extends parallel to and beneath the circle and is fixedly coupled thereto. As the circle is operably driven via the circle drive, the blade 46 is also angularly adjusted. This particular design is conventional and known in the art.

Referring now to FIG. 2, a conventional saddle assembly 200 is shown. Here, the saddle assembly 200 includes a four-bar linkage, referred to as the saddle, and it comprises a first or left saddle arm 202, a second or right saddle arm 204, a saddle top member 206, and a saddle lock bar 208. In this embodiment, the first saddle arm 202 is pivotally coupled to the saddle top member 206 via pivot connection 226. Similarly, the second saddle arm 204 is pivotally coupled to the saddle top member 206 via pivot connection 228. In this manner, the first and second saddle arms are capable of pivoting relative to the top member 206.

The first saddle arm 202 is also pivotally coupled to the saddle lock bar 208 via pivot connection 230, and the second saddle arm 204 is pivotally coupled to the saddle lock bar 208 via pivot connection 232. Thus, the first and second saddle arms 202, 204 are able to pivot relative to the saddle lock bar 208.

The saddle assembly 200 is coupled to a main frame 210 (or front frame 12).

In the depicted embodiment of FIG. 2, the motor grader is equipped with a first lift cylinder 212, a second lift cylinder 214, and a side swing cylinder 216. Each cylinder includes a base and a rod 220. The first lift cylinder 212 is pivotally coupled to the first saddle arm 202 via pivot connection 222. Likewise, the second lift cylinder 214 is pivotally coupled to the second saddle arm 204 via pivot connection 224.

A conventional saddle assembly such as the one in FIG. 2 is arranged such that a position of the draft frame or drawbar 30 is set by each of the two lift cylinders 212, 214 and the side swing cylinder 216 being attached to the four-bar linkage or saddle assembly 200. As noted, the draw frame 30 is further connected to the main frame 210 of the machine. As known in the art, the draw frame 30 may comprise an A-shaped frame body and is connected to the ball and socket arrangement 32 at the front or main frame 210. The main frame 210 pulls the draft frame 30, but the draft frame 30 is adjustable relative to the main frame 210. The aforementioned saddle assembly 200 or four-bar linkage allows for this adjustability.

In order to set the position of the draw frame 30, the saddle assembly 200 position is set by a saddle locking pin (not shown) that engages the saddle lock bar 208 or saddle arms. In FIG. 2, for example, it is known in the art for the saddle lock bar 208 to include a plurality of holes or apertures 218 through which the saddle locking pin engages. Moreover, each saddle arm may also include a hole or aperture 218 through which the locking pin may engage. Each hole or aperture 218 represents a different position in which the saddle assembly 200 is coupled to a draft frame.

With the retractable locking pin engaged in one of the holes 218, the draft frame position is set and it further defines the rotation of the saddle assembly 200 in relation to the main frame 210. Saddle position is thus limited to one of the positions defined by a hole or aperture 218 in the saddle lock bar 208 or saddle arms. In the example of FIG. 2, the saddle lock bar 208 includes five holes 218 and the first and second saddle arms 202, 204 each include a single hole 218. Thus, in the illustrated embodiment, there are only seven discrete saddle positions.

It is also noteworthy that in the embodiment of FIG. 2, the blade or moldboard 46 must be lowered and resting on the ground before the locking pin can be removed and a new position set. The moldboard 46 is heavy and its weight restricts the ability to remove the locking pin when raised above the ground. Thus, saddle position is only adjustable in this conventional embodiment when the moldboard 46 is resting on the ground.

Figure 3:
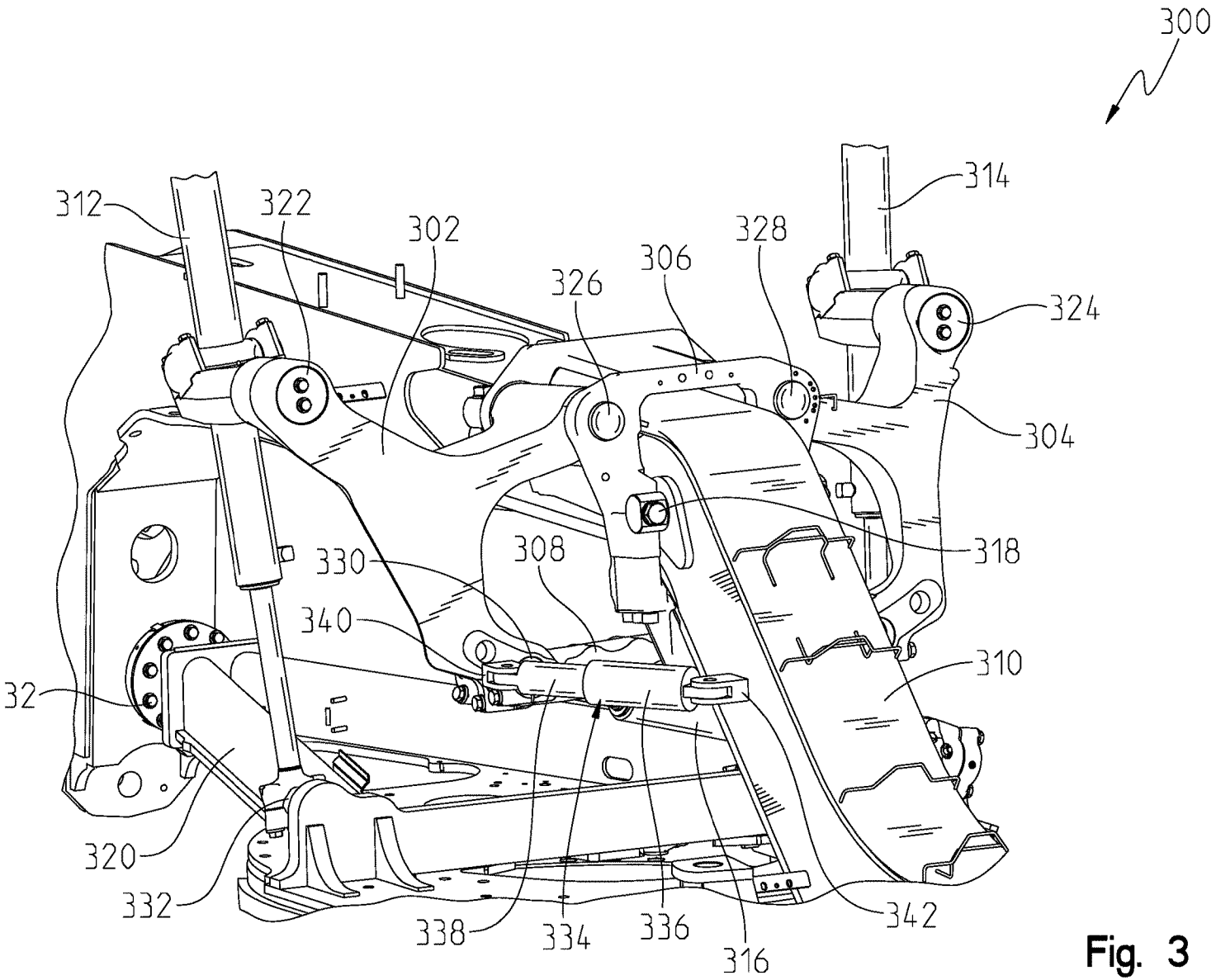
FIG. 3 is a partial side perspective view of a first embodiment of a saddle positioning system.

In FIG. 3, an embodiment of a different saddle assembly 300 is illustrated. In this embodiment, the draft frame position may be operably adjustable via a position cylinder or actuator rather than a retractable locking pin. This will be described shortly.

In this illustrated embodiment, however, the saddle assembly 300 may include a first saddle arm 302, a second saddle arm 304, a saddle top member 306, and a saddle lock bar 308 as shown. Thus, the saddle assembly 300 of FIG. 3 is similar to that of FIG. 2. Moreover, the position of the draft frame 320 may be set by a first lift cylinder 312, a second lift cylinder 314 and a side swing cylinder 316. These cylinders may be coupled to the saddle assembly 300 and further coupled to a main frame 310 of the motor grader. For example, the saddle arms may be coupled to the main frame 310 via a pinned connection 318.

In the embodiment of FIG. 3, the first lift cylinder 312, the second lift cylinder 314, and the side swing cylinder 316 may include a base end and a rod end. Each cylinder may be an electric, hydraulic, mechanical, electrohydraulic, electro-mechanical, pneumatic, or any combination thereof. The first lift cylinder 312 is pivotally coupled to the first saddle arm 302 via pivot connection 322. Likewise, the second lift cylinder 314 is pivotally coupled to the second saddle arm 304 via pivot connection 324. The rod end of each lift cylinder may be coupled to the draft frame 320 via pivot connection 332.

Moreover, the first saddle arm 302 is pivotally coupled to the saddle top member 306 via pivot connection 326. Similarly, the second saddle arm 304 is pivotally coupled to the saddle top member 306 via pivot connection 328. In this manner, the first and second saddle arms are capable of pivoting relative to the top member 306.

The first saddle arm 302 is also pivotally coupled to the saddle lock bar 308 via pivot connection 330, and the second saddle arm 304 is pivotally coupled to the saddle lock bar 308 via another pivot connection (not shown). Thus, the first and second saddle arms 302, 304 are able to pivot relative to the saddle lock bar 308.

In the embodiment of FIG. 3, it is noteworthy that a locking pin is replaced by a saddle position cylinder 334, as shown. The saddle position cylinder 334 may include a base end 336 and a rod end 338, where the rod end 338 extends and retracts relative to the base end 336. The saddle position cylinder 334 may be an electric, hydraulic, mechanical, electrohydraulic, electro-mechanical, pneumatic, or any combination thereof. In this embodiment, the cylinder 334 may be coupled to the main frame 310 via a first connection 342 (at the base end 336) and to one of the saddle arms via a second connection 340 (at the rod end 338). In FIG. 3, the rod end 338 is coupled to the first saddle arm 302, but in other embodiments it may be coupled to the second saddle arm 304. In an alternative embodiment, the cylinder 334 may be coupled to the saddle lock bar 308.

Although not shown in FIG. 3, it is possible the cylinder 334 may be coupled to one of the saddle arms or lock bar via a ball joint.

In any event, the manual retractable locking pin of the conventional saddle assembly 200 is replaced by the saddle position cylinder 334 in FIG. 3. This saddle position cylinder 334 may be actuated to control draft frame position without requiring an operator or user to exit the cab 20 and manually move the locking pin to a different location. Advantageously, the moldboard no longer is required to be grounded for the draft frame position to change. Instead, it may be possible to extend or retract the cylinder 334 automatically via a controller, or an operator may control movement from inside the cab 20 via an operator control. If, for example, the cylinder 334 is electrically controlled, the operator may be able to adjust a lever, switch or the like to cause the cylinder 334 to extend or retract.

It is also possible to adjust the draft frame position to an infinite number of positions within the travel range of the saddle assembly 200, rather than the limited seven discrete positions of FIG. 2. Moreover, one or more sensors may be coupled to the saddle assembly 200 and saddle position cylinder 334 and communicate with a controller so that the position of the saddle is always known. With the known saddle position and infinite adjustability of the draft frame, more efficient and productive grading operations may be performed.

Figure 4:
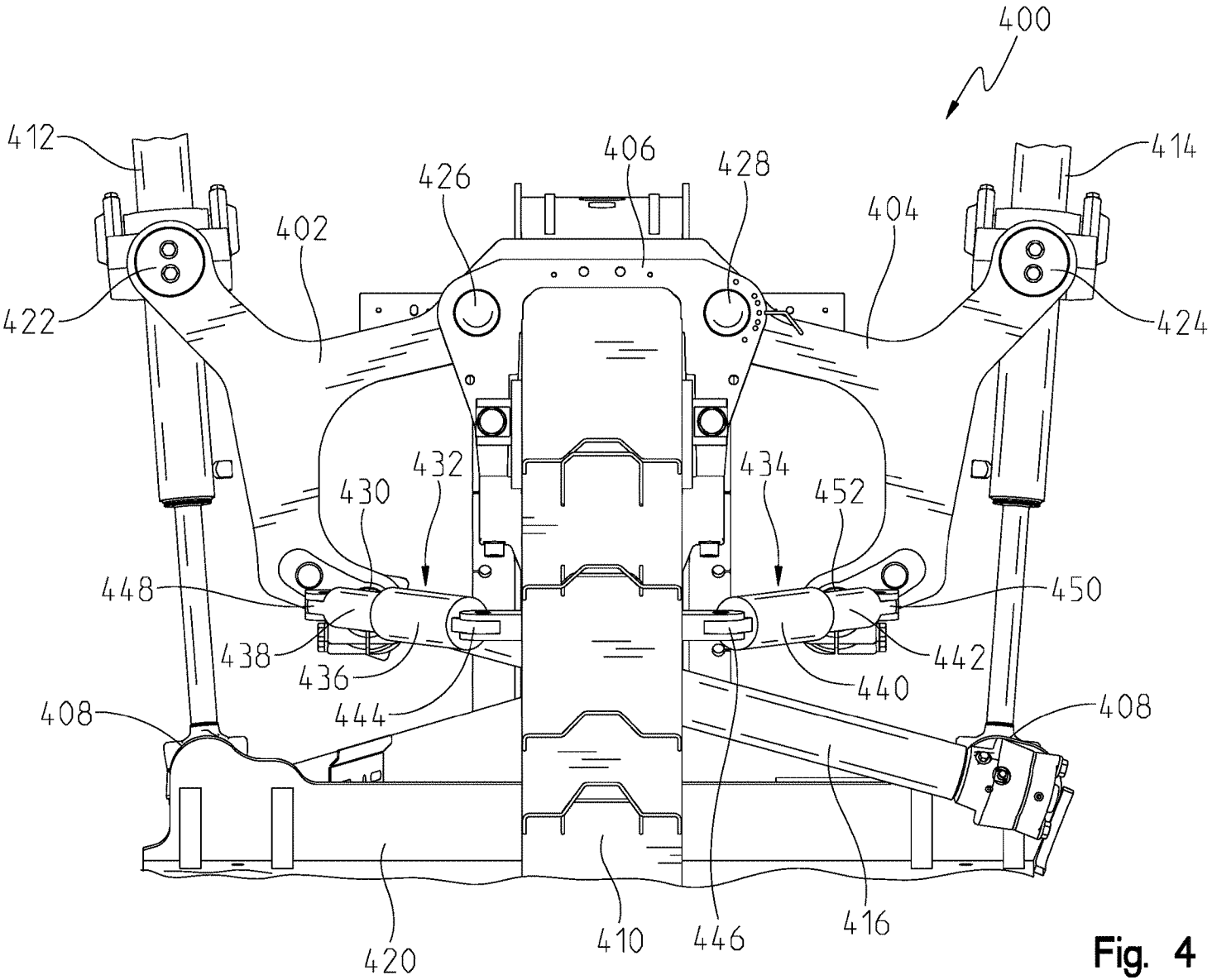
FIG. 4 is a rear view of a second embodiment of a saddle positioning system.

Turning now to FIG. 4, another embodiment of a saddle assembly 400 is illustrated. In this embodiment, the draft frame position may be operably adjustable via a pair of position cylinders or actuators rather than a retractable locking pin (FIG. 2) and a single position cylinder (FIG. 3). This alternative design will be described below.

In this illustrated embodiment, however, the saddle assembly 400 may include a first saddle arm 402, a second saddle arm 404, and a saddle top member 406. It is noteworthy that in this embodiment the saddle assembly 400 does not include a saddle lock bar. Thus, the saddle assembly 400 of FIG. 4 is different from that of FIG. 3. Moreover, the position of the draft frame 420 may be set by a first lift cylinder 412, a second lift cylinder 414 and a side swing cylinder 416. These cylinders may be coupled to the saddle assembly 400 and further coupled to a main frame 410 of the motor grader. For example, the pair of lift cylinders may be coupled to the draft frame via pivotal connection 408.

In FIG. 4, the first lift cylinder 412, the second lift cylinder 414, and the side swing cylinder 416 may include a base end and a rod end. Each cylinder may be an electric, hydraulic, mechanical, electrohydraulic, electro-mechanical, pneumatic, or any combination thereof. The first lift cylinder 412 is pivotally coupled to the first saddle arm 402 via pivot connection 422. Likewise, the second lift cylinder 414 is pivotally coupled to the second saddle arm 404 via pivot connection 424. As noted above and shown in FIG. 3, the rod end of each lift cylinder may be coupled to the draft frame 420 via pivot connection 408.

Moreover, the first saddle arm 402 is pivotally coupled to the saddle top member 406 via pivot connection 426. Similarly, the second saddle arm 404 is pivotally coupled to the saddle top member 406 via pivot connection 428. In this manner, the first and second saddle arms are capable of pivoting relative to the top member 406. The side swing cylinder 416 may be coupled to one of the saddle arms 402, 404 via a first pivot connection 430 or a second pivot connection 452 (depending upon the saddle arm).

In this embodiment, the saddle assembly 400 does not include a saddle lock bar, and thus the first and second saddle arms do not couple to the lock bar. Instead, the saddle locking pin and lock bar are replaced with a pair of position sensing cylinders coupled to the respective saddle arms. For instance, a first saddle sensing position cylinder 432 may be coupled to the first saddle arm 402 at a first location 448 and to the main frame 410 or saddle top member 406 at a second location 444. In FIG. 4, the cylinder 432 is shown being coupled to the main frame 410, but it should be understood that in a different embodiment the cylinder may be coupled between the saddle arm 402 and the saddle top member 406.

The first saddle sensing position cylinder 432 may include a base end 436 and a rod end 438. The base end 436 may be coupled to the main frame 410 or saddle top member 406, whereas the rod end 438 may be coupled to the first saddle arm 402.

A second saddle sensing position cylinder 434 is also shown in FIG. 4. The second position cylinder 434 may be coupled to the second saddle arm 404 at a first location 450 and to the main frame 410 or saddle top member 406 at a second location 446. Like the first saddle sensing position cylinder 432, the second saddle sensing position cylinder 434 may include a base end 440 and a rod end 442. The base end 440 may be coupled to the main frame 410 or top member 406 at the second location 446, whereas the rod end 442 may be coupled to the second saddle arm 404 at the first location 450.

In this embodiment, each of the saddle sensing position cylinders may be operably controlled independently of one another. As such, it is possible to individually control the travel of each saddle arm independently of the other saddle arm. With this independent saddle arm control, different motion and greater travel of the moldboard is possible compared to the saddle assemblies of FIGS. 2 and 3.

For instance, in the conventional saddle assembly 200 of FIG. 2, when one saddle arm is controlled to move downwardly, the other saddle arm must respond by moving upwardly. These limitations in the saddle assembly 200 reduce the amount of travel or reach of the moldboard. Since the cylinders and saddle assembly are connected to one another, movement of one lift cylinder and the side swing cylinder induces movement in the other lift cylinder since they are all connected via the four-bar linkage, i.e., saddle assembly 200. Thus, there is a limit to how far to either direction of the centerline of the machine the moldboard can extend.

Figure 5:
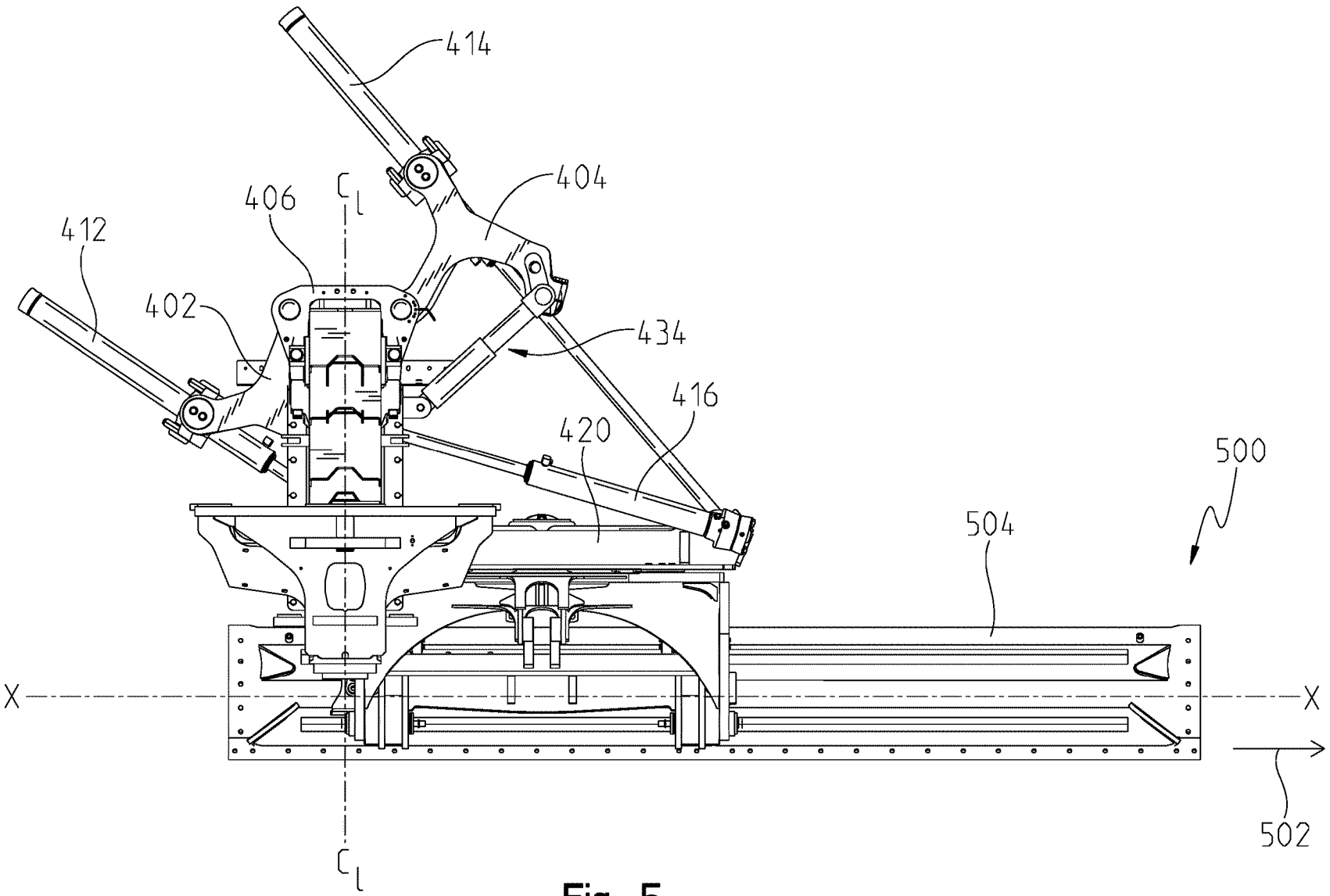
FIG. 5 is a schematic of the saddle positioning system of FIG. 4 with a moldboard disposed in its maximum reach position.

The advantage, however, of the saddle assembly design of FIG. 4 is that the independent control of the saddle arms allows for greater travel and farther reach of the moldboard during a work operation. With a motor grader, it is desirable to be able to reach, or extend laterally (i.e., outwardly), as far as possible from a centerline of the machine. In FIG. 5, for example, a moldboard 504 is shown at a maximum reach position 500 to the right side of the machine. Here, the moldboard 504 is moved laterally in a direction indicated by arrow 502 along axis X. This reach or travel of the moldboard is measured relative to the machine centerline axis, $C_L$, as illustrated. The machine centerline axis, $C_L$, is defined longitudinally along the length of the machine. Due the independent control of each saddle arm in this embodiment, movement of one saddle arm does not induce movement of the other. Thus, it is possible to get greater range of motion or reach with this design.

In the embodiment of FIG. 4, the draft frame may be positioned without lowering the moldboard onto the ground. Similar to the embodiment of FIG. 3, the independent control of the first and second saddle sensing position cylinders 432, 434 allows for the draft frame position to be adjusted without manually removing or retracting the saddle locking pin. Moreover, the adjustability of the draft frame position may be automatically controlled by a controller, or in some embodiments an operator of the grader may be able to make adjustments as desired.

Figure 6:
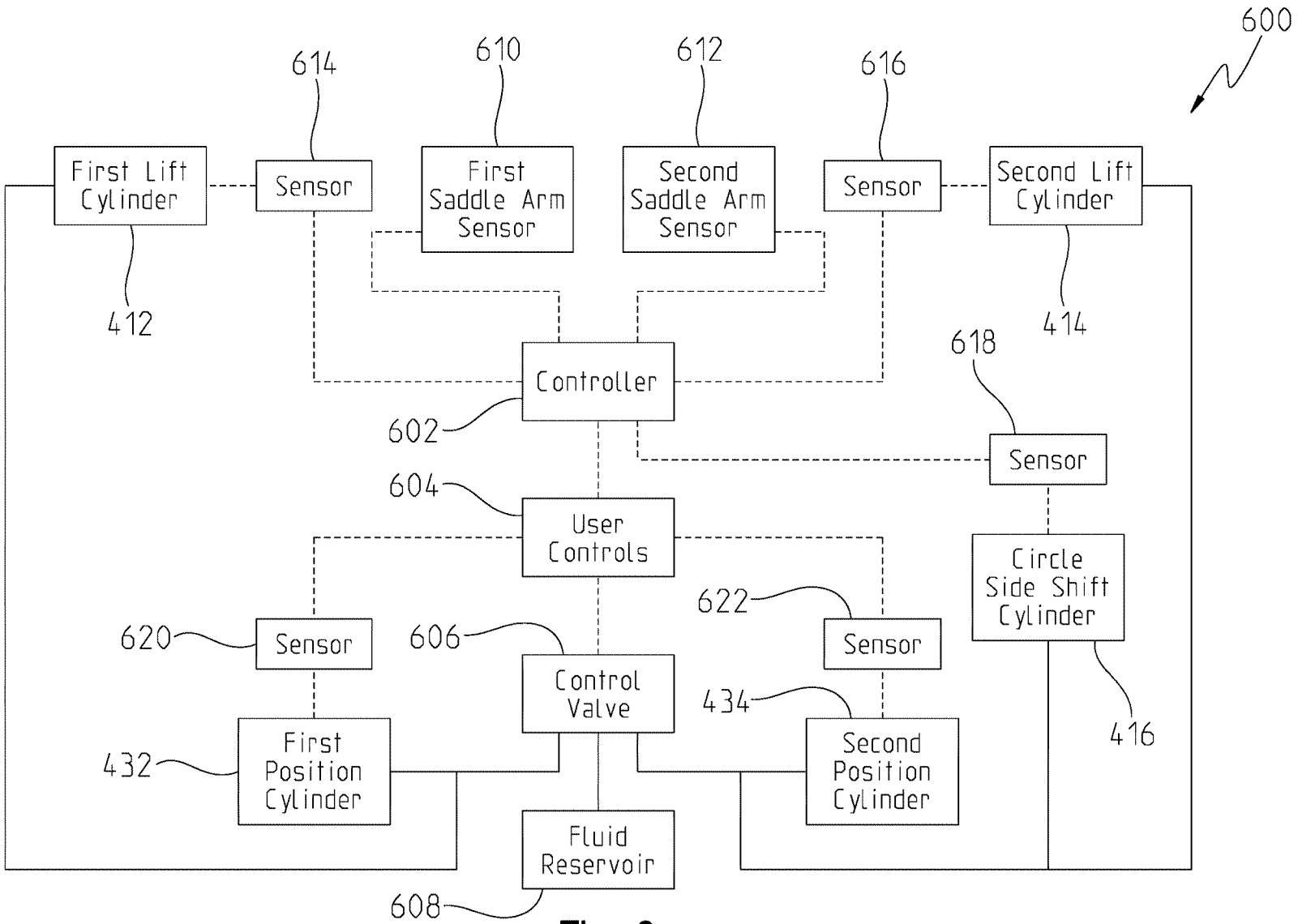
FIG. 6 is a schematic of one embodiment of an electro-hydraulic control system for controlling the saddle positioning system of FIG. 4.

In FIG. 6, one non-limiting embodiment of a control system 600 is shown for controlling the saddle positioning system of FIG. 4. In this system 600, a controller 602 may operably control the functionality of the saddle assembly 400 and each cylinder. In some instances, the controller 602 may operably control the positioning of the draft frame and saddle arms automatically without input from the motor grader operator. In other instances, the operator may be able to command the controller 602 to operably control the draft frame positioning. In this latter case, user controls 604 may be provided, for example, in the cab of the machine.

In this embodiment, the control system 600 is an electro-hydraulic control system in which a control valve 606 may be operably controlled between an open and closed position by the controller 602 or user controls 604. Hydraulic fluid from a fluid reservoir 608 may be supplied by a pump or other known device (not shown) to the control valve 606. In FIG. 6, solid lines may depict hydraulic lines between the control valve 606 and the different cylinders, whereas broken lines may represent electrical communication between different components including the controller 604. The control valve 606 may be an electrohydraulic control valve having a solenoid that triggers a valve body to move between open and closed positions. The solenoid (not shown) may be energized or de-energized by either the controller 602 or user controls 604, or in some instances, both. Other arrangements, however, are possible and this description of the control valve is only one embodiment of many that may be used in this system.

In this system 600, the first saddle arm 402 may include a position sensor 610 that is in electrical communication with the controller 602. Likewise, the second saddle arm 404 may include a position sensor 612 that is in electrical communication with the controller 602. Each of these position sensors may communicate the position of the saddle arm relative to the main frame 410 or draft frame. In some instances, the position sensors may be located at the pivotal connection between the saddle arm and top member, or saddle arm and lift cylinder. Alternatively, the position sensors may be mounted at any location on the saddle arm and its position may be detected relative to a fixed location and communicated to the controller 602. In any event, the controller 602 may be in continuous communication with the position sensors so that it is able to detect the actual position of both saddle arms at any given time.

The first lift cylinder 412 may include a position sensor 614 and the second lift cylinder 414 may include a position sensor 616. Both position sensors of the lift cylinders may be in electrical communication with the controller 602. For instance, the position sensors may be located within the respective cylinder to detect real-time stroke length of the rod.

The side shift or side swing cylinder 416 may also include its own position sensor 618 that is in electrical communication with the controller 602. Similar to the lift cylinders, the position sensor 618 may be located inside the cylinder 416 to detect its stroke length at any given time, and communicate the same to the controller 602.

Lastly, each of the saddle sensing position cylinders may include their own sensor. For example, the first saddle sensing position cylinder 432 may include a position sensor 620, and the second saddle sensing position cylinder 434 may include its own position sensor 622. Each of these position sensors may be located within the respective cylinder for detecting stroke length. As such, the sensors 620, 622 may communicate the stroke length of each cylinder to the controller 602.

As the controller 602 receives this information from each sensor, it is able to better control the positioning of the draft frame via the independent control of both saddle arms. In doing so, the moldboard may be controlled to achieve greater reach than conventional, four-bar linkage designs and thus provides better productivity during operation. Moreover, unlike conventional designs, the embodiments in this disclosure provide for automatic or partial automatic control of the draft frame positioning without requiring the moldboard to be placed on the ground first.

While embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A draft frame positioning system of a motor grader having a main frame defining a longitudinal axis and a centerline defined longitudinally along a length of the motor grader, comprising:

an adjustable draft frame configured to be moved to one of a plurality of positions;

a moldboard coupled to the draft frame, the moldboard being movable based on the position of the draft frame wherein the draft frame is adjustable relative to the main frame including being movable laterally with respect to the longitudinal axis;

a saddle assembly coupled between the draft frame and the main frame, the saddle assembly comprising a first saddle arm, a second saddle arm, and a saddle top member coupled between the first and second saddle arms, wherein the first saddle arm is pivotally coupled to the saddle top member at a first pivot connection having a pivot axis generally aligned parallel to the longitudinal axis and the second saddle arm is pivotally coupled to the saddle top member at a second pivot connection having a pivot axis generally aligned parallel to the longitudinal axis; and a saddle positioning cylinder configured to move between an extended position and a retracted position, the saddle positioning cylinder being coupled to the main frame and to the saddle assembly;

wherein, a movement of the saddle positioning cylinder induces lateral movement with respect to a longitudinal axis of one or both of the first saddle arm and the second saddle arm to move the draft frame to any of its plurality of positions including lateral movement of the draft frame with respect to the longitudinal axis, wherein the lateral movement is substantially perpendicular to the centerline of the motor grader, wherein the saddle positioning cylinder is coupled at a first end to the first or second saddle arm of the saddle assembly and at a second end to the main frame.

2. The system of claim 1, wherein:

the saddle assembly comprises a saddle lock bar pivotally coupled between the first saddle arm and the second saddle arm;

the saddle positioning cylinder coupled to the saddle lock bar.

3. The system of claim 1, further comprising:

a first lift cylinder pivotally coupled between the first saddle arm and the draft frame, wherein the first lift cylinder is pivotally coupled to the first saddle arm at a pivot connection having a pivot axis generally aligned with the longitudinal axis;

a second lift cylinder pivotally coupled between the second saddle arm and the draft frame, wherein the second lift cylinder is pivotally coupled to the first saddle arm at a pivot connection having a pivot axis generally aligned with the longitudinal axis; and a side shift cylinder pivotally coupled between the draft frame and the saddle assembly.

4. The system of claim 1, wherein movement of the saddle positioning cylinder induces movement of the draft frame from a first non-discrete position to a second non-discrete position.

5. The system of claim 1, wherein the saddle assembly does not include a lock bar or locking pin such that the position of the draft frame is not defined by engaging the locking pin with the lock bar.

6. The system of claim 1, further comprising a second saddle positioning cylinder configured to move between an extended position and a retracted position, the second saddle positioning cylinder being coupled to the main frame and to the saddle assembly.

7. The system of claim 6, wherein the saddle positioning cylinder is coupled to the first saddle arm and the second saddle positioning cylinder is coupled to the second saddle arm.

8. The system of claim 6, wherein:

the saddle positioning cylinder is coupled at one end to the first saddle arm and at an opposite end to the main frame; and the second saddle positioning cylinder is coupled at one end to the second saddle arm and at an opposite end to the main frame.

9. The system of claim 6, wherein the movement of the saddle positioning cylinder is independent of the movement of the second saddle positioning cylinder.

10. A draft frame positioning system of a motor grader having a main frame defining a longitudinal axis and a centerline defined longitudinally along a length of the motor grader, comprising:

an adjustable draft frame configured to be moved to one of a plurality of positions;

a moldboard coupled to the draft frame, the moldboard being movable based on the position of the draft frame;

a saddle assembly coupled between the draft frame and the main frame, the saddle assembly comprising a first saddle arm, a second saddle arm, and a saddle top member coupled between the first and second saddle arms, wherein the first saddle arm is pivotally coupled to the saddle top member at a first pivot connection having a pivot axis generally aligned parallel to the longitudinal axis and the second saddle arm is pivotally coupled to the saddle top member at a second pivot connection having a pivot axis generally aligned parallel to the longitudinal axis; and a first saddle positioning cylinder configured to move between an extended position and a retracted position, the first saddle positioning cylinder being coupled at one end to the main frame and at an opposite end to the saddle assembly;

a second saddle positioning cylinder configured to move between an extended position and a retracted position, the second saddle positioning cylinder being coupled at one end to the main frame and at an opposite end to the saddle assembly;

wherein, a movement of the first saddle positioning cylinder is independent of a movement of the second saddle positioning cylinder;

wherein, the movement of either the first or the second saddle positioning cylinder induces lateral movement with respect to one or both of the first saddle arm and the second saddle arm to move the draft frame to one of any of its plurality of positions including lateral movement with respect to the longitudinal axis, wherein the lateral movement is substantially perpendicular to the centerline of the motor grader, wherein the first saddle positioning cylinder is coupled to the first saddle arm and the second saddle positioning cylinder is coupled to the second saddle arm.

11. The system of claim 10, wherein the first saddle arm and the second saddle arm are movable independently of one another.

12. The system of claim 10, further comprising:

a first lift cylinder coupled between the first saddle arm and the draft frame;

a second lift cylinder coupled between the second saddle arm and the draft frame; and a side shift cylinder coupled between the draft frame and the saddle assembly.

13. The system of claim 10, wherein movement of either the first or second saddle positioning cylinder induces movement of the draft frame from a first non-discrete position to a second non-discrete position.

14. The system of claim 10, wherein the first saddle positioning cylinder and the second saddle positioning cylinder are coupled to the main frame at one end and a respective saddle arm at an opposite end.

15. A motor grader, comprising:

a main frame defining a longitudinal axis and a centerline defined longitudinally along a length of the motor grader;

a draft frame adjustably coupled to the main frame, the draft frame configured to be adjusted to any of a plurality of positions;

a moldboard configured to perform a grading operation, the moldboard coupled to the draft frame wherein the draft fame is adjustable relative to the main frame including being movable laterally with respect to the longitudinal axis;

a saddle assembly coupled between the draft frame and the main frame, the saddle assembly comprising a first saddle arm, a second saddle arm, and a saddle top member coupled between the first and second saddle arms, wherein the first saddle arm is pivotally coupled to the saddle top member at a first pivot connection having a pivot axis generally aligned parallel to the longitudinal axis and the second saddle arm is pivotally coupled to the saddle top member at a second pivot connection having a pivot axis generally aligned parallel to the longitudinal axis;

a saddle positioning cylinder configured to move between an extended position and a retracted position, the saddle positioning cylinder being coupled at one end to the main frame and at an opposite end to the saddle assembly, wherein the saddle positioning cylinder is coupled to the first saddle arm at the opposite end;

a second saddle positioning cylinder configured to move between an extended position and a retracted position, the second saddle positioning cylinder being coupled at one end to the main frame and at an opposite end to the saddle assembly, wherein the second saddle positioning cylinder is coupled to the second saddle arm at the opposite end; and a control system comprising a controller, a saddle positioning sensor, a first saddle arm sensor, and a second saddle arm sensor;

wherein, a movement of the saddle positioning cylinder induces lateral movement with respect to a longitudinal axis of one or both of the first saddle arm and the second saddle arm to move the draft frame to any of its plurality of positions including lateral movement of the draft frame with respect to the longitudinal axis, wherein the lateral movement is substantially perpendicular to the centerline of the main frame;

wherein, the saddle positioning sensor is electrically coupled to the controller and is configured to detect a position of the saddle positioning cylinder and communicate the position to the controller.

16. The motor grader of claim 15, wherein the position of the draft frame is adjustably controlled automatically via the controller, the controller configured to automatically control movement of the saddle positioning cylinder.

17. The motor grader of claim 15, further comprising:

a second saddle positioning sensor electrically coupled to the controller and configured to detect a position of the second saddle positioning cylinder;

wherein, a movement of the second saddle positioning cylinder is controlled independently of the saddle positioning cylinder;

wherein, a movement of the second saddle positioning cylinder induces movement of the draft frame.

18. The motor grader of claim 17, wherein:

movement of either the first saddle arm or the second saddle arm is independently controlled relative to the other.

* * * * *